United States Patent [19]

Rupert

[11] Patent Number: 4,463,650

[45] Date of Patent: Aug. 7, 1984

[54] SYSTEM FOR CONVERTING ORAL MUSIC TO INSTRUMENTAL MUSIC

[76] Inventor: Robert E. Rupert, P.O. Box 303, South Dennis, Mass. 02660

[21] Appl. No.: 322,739

[22] Filed: Nov. 19, 1981

[51] Int. Cl.[3] ..... G10H 1/02

[52] U.S. Cl. ..... 84/1.19; 84/1.01; 84/1.03; 84/1.24

[58] Field of Search ..... 84/1.24, 1.19, 1.26, 84/1.01, 1.03, 1.16

[56] References Cited

U.S. PATENT DOCUMENTS 3,213,180 10/1965 Cookerly et al. ..... 84/1.16
4,193,332 3/1980 Richardson ..... 84/1.01
4,202,237 5/1980 Hakansson ..... 84/1.24

FOREIGN PATENT DOCUMENTS 54-66826 3/1979 Japan ..... 84/1.24

*Primary Examiner*—Forester W. Isen
*Attorney, Agent, or Firm*—Morse, Altman & Dacey

[57] ABSTRACT

A system is provided in which oral sounds are converted to instrumental musical notes. The system includes a digital memory adapted to store notes of different instruments and of different timbre. A variable address generator connected to the memory is adapted to retrieve the notes at various addressing rates in order to change the pitch thereof. The system is adapted to generate musical instrument output sounds in response to an oral input over a whole range of notes including pitches between whole and half tone increments in an unbroken frequency spectrum of pitch.

6 Claims, 4 Drawing Figures

SYSTEM FOR CONVERTING ORAL MUSIC TO INSTRUMENTAL MUSIC

BACKGROUND OF THE INVENTION

1. Field of the Invention

This invention relates generally to an electronic system in which musical instrument sounds are artificially generated from a voice input.

2. Description of the Prior Art

In my U.S. Pat. Nos. 3,484,530 and 3,634,596 there are disclosed systems for producing musical outputs from a memory containing recorded musical notes that can be stimulated by single note inputs through a microphone. The systems disclosed in these patents are able to detect pitch, attack, sustain and decay as well as volume level and are able to apply these sensed inputs to the recorded note being played back. In effect, the systems are musical note to musical note converters that may be converted fast enough so that no lag can be detected by the listener or by the player. In each instance the recorded notes are those of a real musical instrument having played the chromatic scale. The reproduction of these notes produces the same type of instrument that is commonly heard on phonograph records or magnetic tape of commerically produced music. The systems are believed to be superior to conventional electronic musical note synthesizers that, typically, are not entirely faithful to the instrumental sounds that are intended to be recreated.

In the systems disclosed in the above patents, the memory is capable of containing discrete notes of the chromatic scale and respond to discrete input notes of the same pitch. The system is analogous to a keyboard instrument where the player has only discrete notes to choose from and actuates one by depressing that particular key. Other musical instruments give a player a choice of pitches between whole and half tone increments. For example, a violin can produce a pitch which is variable depending upon where the string is fretted or a slide trombone can cause a pitch falling in between whole and half tone increments. Both of these instruments produce an unbroken frequency spectrum of pitch. However, prior art systems have not been able to provide a continually varying pitch at the output in response to a continually varying pitch at the input nor have they been able to produce a note timbre that realistically duplicates what a real instrument does as a function of pitch over the range of the instrument nor provide a note quality or timbre which realistically duplicates what a real instrument does as a function of degree of force at the input of an instrument.

Accordingly, it is an object of the present invention to provide improvements in system for artificially generating sounds of musical instruments in response to an input.

Another object of this invention is to provide a voice operated system adapted to generate the sound of a musical instrument that faithfully reproduces the true sound of the instrument over an unbroken frequency spectrum of pitch and generates notes that duplicate the note quality in relation to pitch and force corresponding to a real instrument.

SUMMARY OF THE INVENTION

This invention features a system for use in generating the sound of a musical instrument in response to a voice input that is capable of operation over an unbroken frequency spectrum of pitch and is adapted to recreate the sound of the instrument in note quality or timber as a function of pitch and force at the input. The system includes a microphone to receive the input voice signal and a loud speaker to produce the instrumental music in response to the voice input. Instrumental musical notes are stored in digital form in a digital memory with the memory being connected to control circuitry by means of which the information stored in the memory can be retrieved at various addressing rates whereby the pitch of a particular note can be changed. The circuit controls also include means for altering the octave range to match the user's voice with the instrumental notes stored in the memory.

Other circuit components are adapted to faithfully reproduce the instrumental music in pitch and force as if an actual musical instrument were being played.

DETAILED DESCRIPTION OF THE PREFERRED EMBODIMENT

Figure 1:
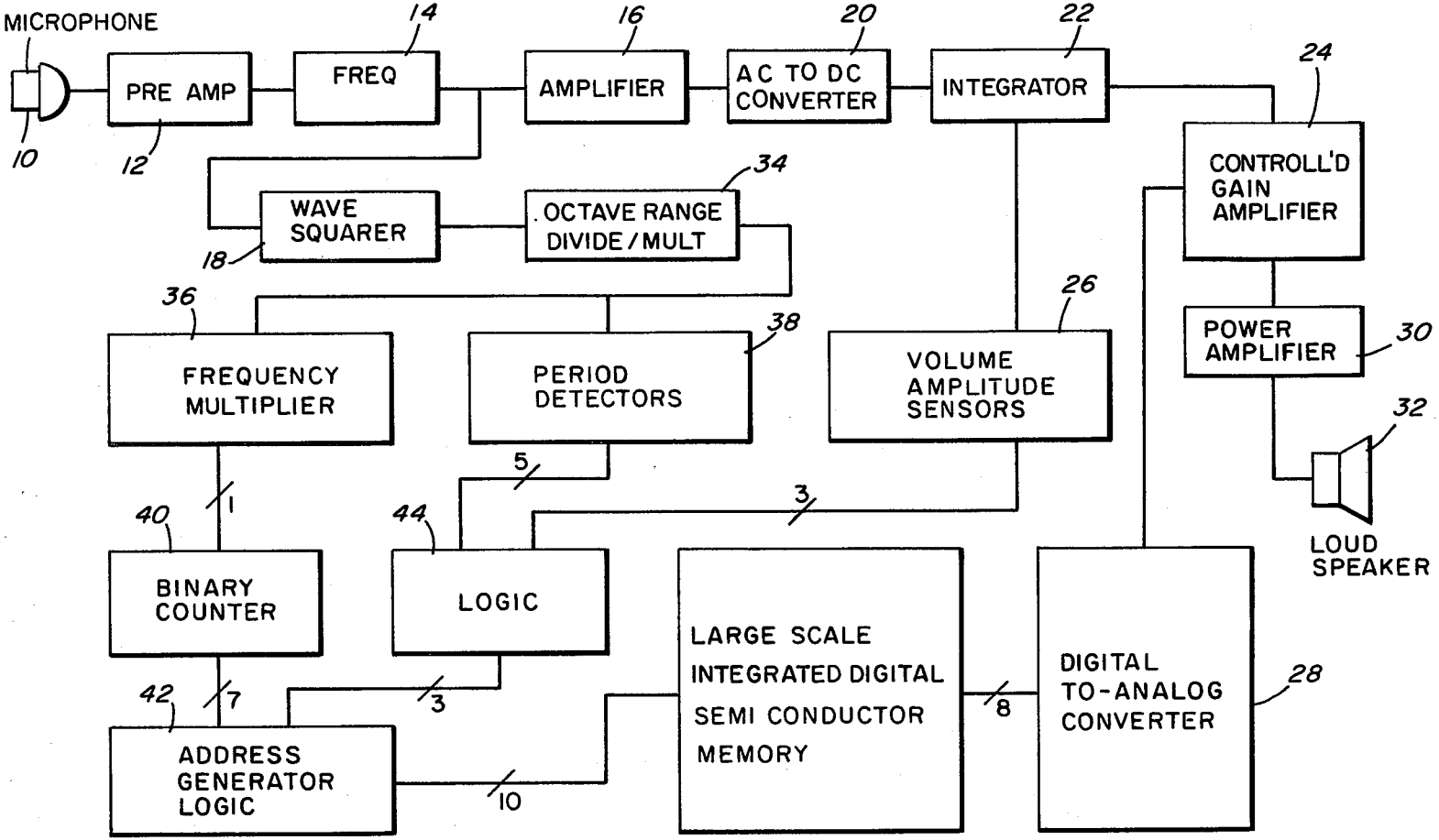
FIG. 1 is a block diagram of a voice operated system for producing instrumental music made in accordance with the invention.

Operation of the system disclosed herein is based upon the principle that the human voice is itself a musical source. The vocal cords when coupled with the action of air from the lungs, the tongue and the lips produce what is commonly designated as "mouth music". Many performers have developed skills in imitating the sounds of real musical instruments and, in fact, some musical groups have been formed in which each musician mouths the part of a real instrument to form a pseudo instrumental orchestra. For the average player, however, this method requires that he hum or emit a monosyllabic tone with each note. Humming produces a gentle attack and lends itself to producing slurring of notes. On the other hand, a monosyllabic tone such as "ta" or "la" can produce a much sharper attack for discrete notes. Whistling can do both of these things and does not require the use of the vocal chords.

In the present invention an electronic system is provided in which real instrumental notes are contained in a memory with the system responsive to the stimuli of mouth music to create a playable musical instruments that will respond to the mouth music stimuli in real time.

In the system disclosed herein not only can a musical instrument be reproduced with respect to discrete notes, but can also generate an unbroken frequency spectrum of pitch to accommodate those instruments in which the player has a choice of pitches between whole and half tone increments (violin, trombone, etc.). In addition, the system is adapted to generate a variation in timbre for each note stimulated, that variation being selected in accordance with the player's input in the same manner as would occur if that person were playing an actual instrument. By way of definition, timbre refers to the quality of a musical note and consists of a mixture of fundamental and harmonic frequencies. Major changes in timbre occur for notes over an octave range for most instruments. Changes in timbre also occur depending on how a note is played. For example, on a brass instrument a performer can blow into the mouth piece gently and produce a soft, pleasing note or he can blow with more vigor and produce a note that is firm, and, finally, he can blow with a great deal of emphasis and produce what is termed an overblown note that is raspy and harsh. Each one of these notes can be recognized by the listener as an unmistakable characteristic of the instrument being played and is a necessary part of the instrument's output for the performer to achieve full musical expression as dictated by the composer of the music or by the player's own interpretation of that music.

The present system is therefore characterized by the ability to generate a continually varying pitch at the input. This system is also characterized by the ability to generate an output in which the quality of the notes or timbre realistically duplicate that which a real instrument would do as a function of pitch over the range of the real instrument. In addition the system recreates what a real instrument does as a function of the force at the input of the instrument. The system is also adapted to sense the other functions for proper stimuli, mainly pitch, attack, sustain and decay.

Referring now to the drawings and to FIG. 1 in particular, there is illustrated in block diagram the system of the present invention having the capabilities set forth above. The input to the system is by means of a microphone 10 which produces an AC output delivered first to a preamplifier 12 then to a frequency compensator 14 having a pair of outputs, one to an amplifier 16 and another to a wave squarer 18 which senses the fundamental frequency by zero crossing detection. The output of the amplifier 16 is to an AC/DC converter 20 feeding into an integrator 22 having a pair of DC outputs. One of the DC outputs is to a controlled gain amplifier 24 while the other is to a set of volume amplitude sensors 26. The gain control amplifier 24 also receives analog signals from a D/A converter 28 and provides an input to a power amplifier 30 driving a loudspeaker 32 from which the output sound, in the form of instrumental music, is emitted.

Because the DC output of the integrator 22 controls the amplifier 24, it will be understood that the input signal amplitude controls the output signal during attack, sustain and decay of any given note that enters the microphone 10. The function of the wave squarer 18 is to change the AC input waveform to a square wave with the exact period of the input wave. This is necessary for frequency relationship between the input and output pitch. An octave range divider/multiplier circuit 34 receives the square wave output of the wave squarer 18 and divides or multiplies the input signal so that a high pitch or low pitch voice stimulation will correspond to the pitch range of the instrument being played. For example, if a soprano wishes to play the system as a tuba, her voice would be to high pitched for the tuba. Consequently, she would select the appropriate octave range setting by a front panel control to match her voice with the instrument. Also, the instrument may have a greater range than her voice so that she can select which end of the range she might want to play on at any time, even during play as the octave ranging is faster than the ear can detect. The same analogy applies to a bass voice that could be stimulating a piccolo, for example.

The output of the octave range divider/multiplier circuit is to a frequency multiplier 36 and to period detectors 38. The function of the frequency multiplier 36 can be provided by any one of several different known circuits such as analog multiplier, digital multiplier or phase locked loops and digital dividers. In the working embodiment a phase locked loop and digital divider was used and found to work satisfactorily.

The frequency multiplier 36 has an output to a binary counter 40 which, in turn, feeds into an address generator logic circuit 42. The outputs of the period detectors 38 and the volume amplitude sensors 26 are to a logic circuit 44 which also provides an input to the address generator logic circuit 42. The address generator logic 42 connects to a memory 46, preferably a large scale integrated digital semiconductor memory adapted to store digitally encoded notes of a musical instrument.

Information that has been stored in the digital memory 46 can be retrieved from the memory at various addressing rates. By storing one cycle of a musical instrument note in the memory and then varying the rate at which it is addressed, the pitch of that note can be changed accordingly. If several notes of different timbre are stored, each one cycle in length, but all of them containing the same number of data words, they can be scanned by a common address generator and will reproduce varying note characteristics at the same frequency (pitch) when played back one at a time. If those several notes are originally different in pitch and have the same number of sample points for one cycle, they can provide a characteristic note over a limited range of pitch above and below that recorded pitch. A simple relationship exists between the number of points sampled from one cycle of recorded note and the scanning rate of the memory. If the number of points recorded for one cycle were 128 and the frequency (or pitch) were 100 hertz, then an input frequency of 12,800 hertz to the binary counter 40, which resets every 128 counts, the memory will reproduce the same output frequency or pitch as that applied to the input (assuming a one-to-one correspondence between the pitch of the voice and the pitch of the instrument being played; if it is not, the octave generator 34 will compensate for the difference).

Figure 2A:
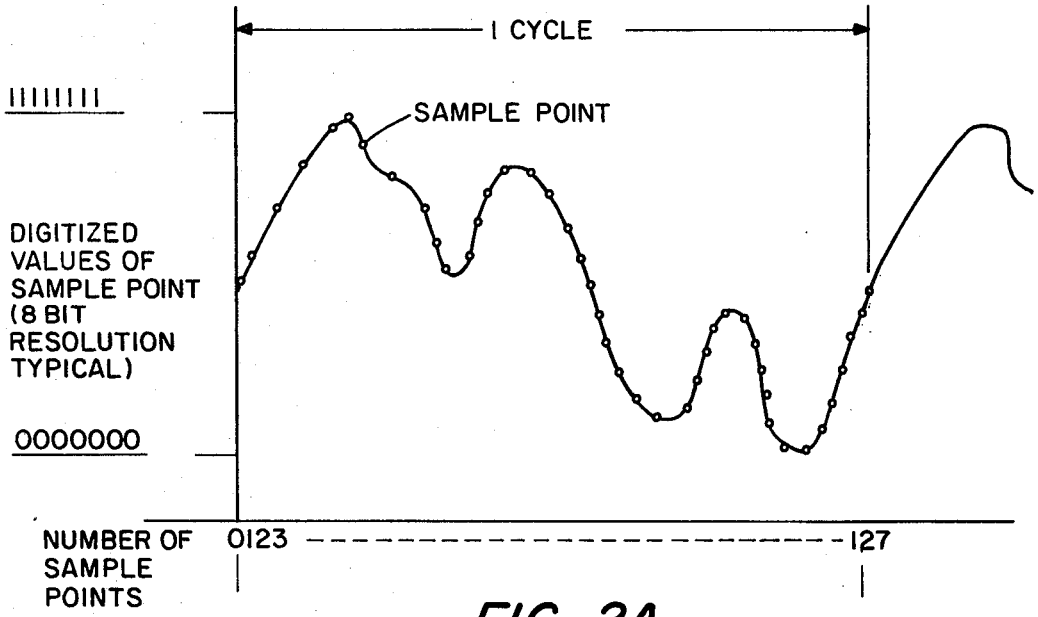
FIGS. 2A and 2B are waveforms of low pitched and high pitched notes, respectively, digitized and stored in the memory, and, FIG. 3 is a diagram indicating how the variable pitch is obtained from the memory.
Figure 2B:
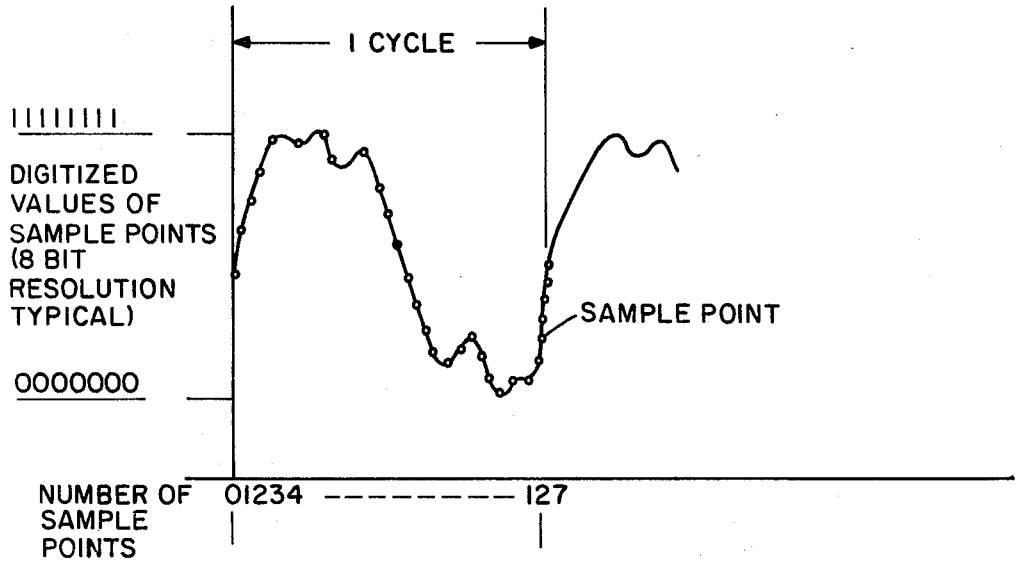

Referring now to FIGS. 2A and 2B, there are depicted the waveforms that are recorded for the memory 46. Each waveform, regardless of its period, contains the same number of sampled points which ultimately become digitized words that are stored in the memory 46. It has been found that amplitude resolution of 8 bits is quite satisfactory for good quality recording. A 7 bit resolution is likewise sufficient for the waveform reproduction. For semiconductor memories of large capacities of 32,000 or 64,000 bits, this will permit many cycles to be stored.

Figure 3:
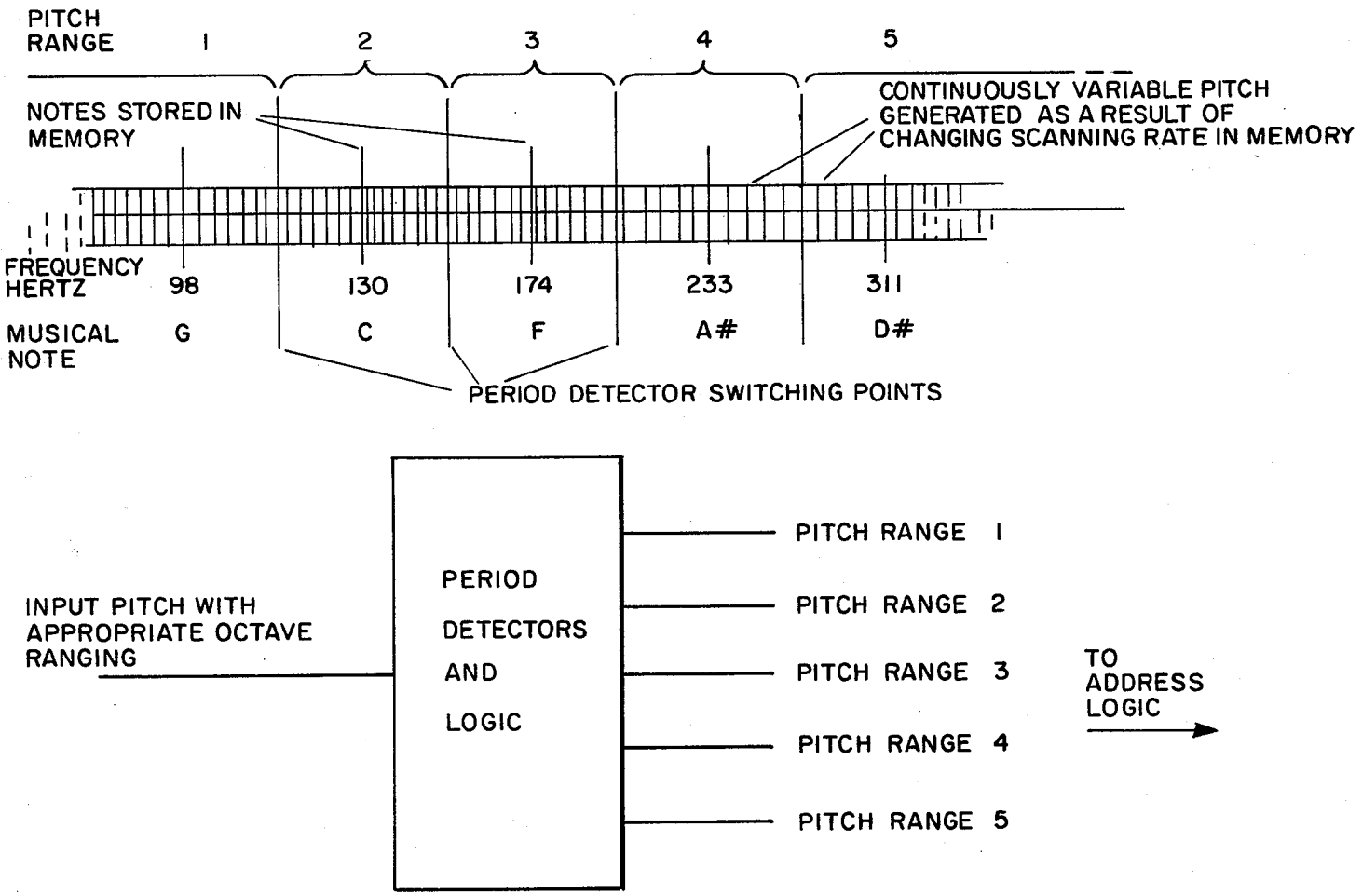

Referring now to FIG. 3, there is graphically illustrated the technique by means of which the variable pitch is achieved. By recording only several notes for the memory 46 and varying the scanning rate around each of these notes, continuously variable pitch can be produced. A range of plus or minus two chromatic notes allows each pitch range to cover five notes on the chromatic scale. The function of the period detectors 38 is to actuate the recorded note for each one of these ranges. For example, if an input pitch falls within the range of pitch range 2 in FIG. 3, the recorded musical note C (130 hertz) will be actuated in the memory 46. If the input pitch happens to be exactly 130 hertz, this is what will appear at the output. If there is any other pitch within the range of the pitch range 2, that frequency or pitch will change the scanning rate of recorded note C producing a corresponding change in pitch.

To generate differences in timbre for the same note being played, the note recorded is recorded several times. For example, one note can be played softly then moderately and then forcefully with each variation being recorded. These three variations are then digitized for one cycle only and stored at discrete locations in the memory. To retrieve these selectively, the volume amplitude sensors 26 sense the volume level of the input, for example, by using a level or window detector that actuates one of these timbre variations (through logic and memory addressing). For a rapidly ascending note, like attack, all three of these timbre variations might come into play or on a slow decay they all may be actuated.

The total address word, as shown in FIG. 1, is made up of 10 bits. Part of the address produces the scan and the remaining parts become the location of a particular waveform to be retrieved. The frequency multiplier constant always equals the number of points recorded for each waveform. In this case that constant is 128, so that incoming signals (pitch) are multiplied by that factor before reaching the binary counter.

In operation the three basic functions of the system are achieved in the following manner:

1. A continuous pitch input at the microphone 10 yields a continuous pitch output at the speaker 32. Such a condition involves utilization of circuit components 12, 14, 18, 34, 36, 38, 40, 44, 42, 46, 28, 24, 30 and 32.

2. Note timbre as a function of note pitch over the range of the instrument involves recorded notes for each pitch range as illustrated in FIG. 3 together with variations produced with the input level. Such an addition involves the above-identified circuits as well as circuits 26, 20 and 22.

3. Note timbre as a function of the force used to create the input signal utilizes circuit components 12, 14, 16, 20, 22, 26, 44, 42, 46, 28, 24, 30 and 32.

The function of the D/A converter 28 is to convert the digital output of the semiconductor memory 46 back to an analog output useful in the output amplifier circuits 24 and 30 for driving the speaker 32.

While the invention has been described with particular reference to the illustrated embodiment, numerous modifications thereto will appear to those skilled in the art.

Having thus described the invention, what I claim and desire to obtain by Letters Patent of the United States is:

1. An electronic system for converting mouth music to instrumental music, comprising (a) a microphone adapted to receive mouth music as as input to said system and adapted to produce analog electrical signals corresponding to said mouth music;

(b) a loudspeaker adapted to emit instrumental music as an audio output from said system;

(c) AC/DC converting means connected to said microphone for converting said input signal to direct current;

(d) an output amplifier connected to said loudspeaker and to said AC/DC converting means, the gain of said output amplifier being responsive to said direct current;

(e) wave shaping means connected to said microphone for producing pulsed signals corresponding to the fundamental frequency of said mouth music;

(f) fundamental frequency sensing means connecting said wave shaping means to said microphone;

(g) frequency multiplying means and period detecting means connected to said wave shaping means;

(h) counting means connected to said frequency multiplying means;

(i) logic means connected to said period detecting means;

(j) volume amplitude sensing means connected to said AC/DC converting means and to said logic means;

(k) address generator logic means connected to said counting means and to said logic means;

(l) digital memory means connected to said address generator logic means and storing a plurality of instrumental musical notes of different waveshapes in digital form therein;

(m) D/A converting means connected to said memory means and to said output amplifier;

(n) said address generator logic means having a variable addressing rate responsive to the pitch of said mouth music whereby the scanning rate of said memory means will be varied to vary the pitch of the musical notes in said memory means;

(o) said volume amplitude sensing means adapted to retrieve notes having different waveshapes stored in said memory means in response to and as a function of the amplitude of said mouth music to thereby control the timbre of the musical notes retrieved from said memory means; and (p) octave range divider multiplier means connected between said fundamental frequency sensing means and said frequency multiplying means and said period detecting means for selectively matching the pitch of the in put to the pitch of the instrumental music;

(q) said AC/DC converting means including an integrator connected to said volume amplitude sensing means and to said output amplifier.

2. A system according to claim 1 wherein said frequency multiplying means is an analog multiplier.

3. A system according to claim 1 wherein said frequency multiplying means is a digital multiplier.

4. A system according to claim 1 wherein said frequency multiplying means is comprised of phase-locked loops and digital dividers.

5. A system according to claim 1 wherein said volume amplitude sensing means is a level detector.

6. A system according to claim 1 wherein said volume amplitude sensing means is a window detector.

* * * * *